US007836622B1

(12) United States Patent
King et al.

(10) Patent No.: US 7,836,622 B1
(45) Date of Patent: Nov. 23, 2010

(54) FOLDABLE TAG WITH EXPANDABLE LOOP

(75) Inventors: Justin C. King, Rushmore, MN (US); Jeffrey D. Tschetter, Sioux Falls, SD (US); Robert B. Ludlow, Worthington, MN (US); Colin M. O'Donnell, Bigelow, MN (US)

(73) Assignee: Bedford Industries, Inc., Worthington, MN (US)

( * ) Notice: Subject to any disclaimer, the term of this patent is extended or adjusted under 35 U.S.C. 154(b) by 26 days.

(21) Appl. No.: 11/529,697

(22) Filed: Sep. 28, 2006

(51) Int. Cl.
*G09F 3/14* (2006.01)

(52) U.S. Cl. ..... 40/665; 40/672; 206/820

(58) Field of Classification Search ..... 40/665, 40/27, 637, 672, 124.01; 156/556; 204/476
See application file for complete search history.

(56) References Cited

U.S. PATENT DOCUMENTS

| | | | | | |
|---|---|---|---|---|---|
| 92,895 | A | * | 7/1869 | Southworth | 40/27 |
| 109,263 | A | | 11/1870 | Southworth et al. | 40/27 |
| 134,116 | A | | 12/1872 | West | 248/118.1 |
| 224,958 | A | | 2/1880 | Rowland | |
| 263,600 | A | | 8/1882 | Searing | |
| D28,619 | S | | 5/1898 | McFadden | |
| 2,516,292 | A | | 7/1950 | Bennett | |
| 2,669,047 | A | * | 2/1954 | Rieger | 40/637 |
| 3,077,683 | A | * | 2/1963 | Jones | 40/638 |
| 3,164,250 | A | | 1/1965 | Paxton | |
| 3,545,795 | A | | 12/1970 | Hertel | |
| 3,602,957 | A | | 9/1971 | Chang | |
| 3,621,809 | A | | 11/1971 | Paxton | |
| 3,662,480 | A | | 5/1972 | Gilson, Jr. et al. | |
| 3,749,622 | A | | 7/1973 | Sato et al. | |
| 3,777,378 | A | | 12/1973 | Sant'Anselmo | |
| 3,930,506 | A | | 1/1976 | Overend | |
| 3,933,560 | A | | 1/1976 | Muttera | |
| 4,119,449 | A | | 10/1978 | Gould et al. | |
| D251,121 | S | | 2/1979 | Smith | |
| 4,323,608 | A | * | 4/1982 | Denny et al. | 428/43 |
| 4,341,303 | A | * | 7/1982 | Britt | 206/343 |
| 4,407,082 | A | | 10/1983 | Stehouwer | |
| 4,433,498 | A | | 2/1984 | Bienz | 40/634 |
| 4,529,229 | A | * | 7/1985 | Glibbery | 283/81 |
| 4,749,426 | A | | 6/1988 | Wyss | |
| 5,018,286 | A | | 5/1991 | Zahner | |
| 5,087,306 | A | | 2/1992 | Cheung et al. | |
| 5,131,614 | A | | 7/1992 | Garcia et al. | 248/118 |
| 5,207,746 | A | * | 5/1993 | Jones | 283/81 |
| D338,195 | S | | 8/1993 | Sugerman | D14/461 |

(Continued)

FOREIGN PATENT DOCUMENTS

| | | |
|---|---|---|
| EP | 1 136 971 A2 | 9/2001 |

(Continued)

*Primary Examiner*—Lesley Morris
*Assistant Examiner*—Christopher E Veraa
(74) *Attorney, Agent, or Firm*—Westman, Champlin & Kelly, P.A.

(57) ABSTRACT

A foldable tag including multiple fold segments and an expandable loop conjoined to one of the multiple fold segments is disclosed. In illustrated embodiments the foldable tag includes multiple fold segments to form a bi-fold tag or alternatively a tri-fold tag. As disclosed the expandable loop is formed along a portion of an elastomeric sheet that is conjoined with a portion of the foldable tag.

3 Claims, 13 Drawing Sheets

U.S. PATENT DOCUMENTS

| | | | | | |
|---|---|---|---|---|---|
| RE34,366 | E | * | 9/1993 | Instance | 40/638 |
| 5,248,164 | A | * | 9/1993 | Lepretre | 281/22 |
| 5,322,724 | A | | 6/1994 | Levens | |
| 5,348,781 | A | | 9/1994 | Koblella | |
| 5,388,739 | A | | 2/1995 | Gargan | |
| 5,617,656 | A | | 4/1997 | Ludlow et al. | |
| D385,581 | S | | 10/1997 | Linz | D20/42 |
| D386,211 | S | | 11/1997 | Taparauskas, Jr. | |
| 5,683,194 | A | * | 11/1997 | Emmel et al. | 402/79 |
| 5,697,177 | A | | 12/1997 | Ludlow et al. | |
| 5,700,537 | A | * | 12/1997 | Instance | 428/41.9 |
| 5,713,467 | A | | 2/1998 | Kao | 206/349 |
| 5,733,652 | A | | 3/1998 | Stowman et al. | |
| 5,778,583 | A | | 7/1998 | Larsen | |
| 5,866,219 | A | | 2/1999 | McClure et al. | 428/40.1 |
| 6,024,225 | A | | 2/2000 | Van der Donk et al. | |
| 6,058,639 | A | | 5/2000 | Tinklenberg et al. | |
| 6,076,669 | A | | 6/2000 | Ling | 206/349 |
| 6,116,653 | A | | 9/2000 | Oberholzer et al. | 283/74 |
| 6,270,834 | B1 | | 8/2001 | Burrows | |
| 6,271,631 | B1 | | 8/2001 | Burrows | |
| 6,279,255 | B1 | | 8/2001 | Larsen | |
| 6,378,700 | B1 | | 4/2002 | Tong | 206/376 |
| 6,413,122 | B2 | | 7/2002 | Fujioka | 439/680 |
| 6,449,886 | B1 | * | 9/2002 | Gray | 40/124.01 |
| D494,066 | S | | 8/2004 | Liu | D9/457 |
| D501,892 | S | | 2/2005 | Perry | D20/42 |
| 6,991,261 | B2 | * | 1/2006 | Dronzek et al. | 283/81 |
| 7,281,345 | B2 | * | 10/2007 | Ludlow et al. | 40/665 |
| 2003/0150919 | A1 | | 8/2003 | Blank | |
| 2005/0138854 | A1 | | 6/2005 | Simmons | 40/665 |
| 2005/0166439 | A1 | * | 8/2005 | Ludlow et al. | 40/665 |
| 2006/0086028 | A1 | | 4/2006 | Vaughan | 40/665 |
| 2006/0272185 | A1 | * | 12/2006 | Malama et al. | 40/124.01 |

FOREIGN PATENT DOCUMENTS

| | | | |
|---|---|---|---|
| FR | 2634574 | | 1/1990 |
| GB | 2 255 958 | | 11/1992 |
| GB | 2 382 810 | | 6/2003 |
| GB | 2 405 854 | | 3/2005 |
| NL | 1016806 | C | 6/2002 |
| WO | WO 98/24086 | | 6/1998 |
| WO | WO 2007/084119 | | 7/2007 |

* cited by examiner

FOLDABLE TAG WITH EXPANDABLE LOOP

FIELD OF THE INVENTION

The present invention relates to a foldable tag and in particular to a foldable tag with an expandable loop.

BACKGROUND OF THE INVENTION

Tags can be fastened to various manufactured products and other articles to convey information. Such tags can be preprinted with text or other information or include other indicia or distinguishing features. Depending upon the application and design, tags are attached to various articles using different attachments. Often times the attachment or tag may be difficult to remove from the article or product or the tag may not meet the specification requirements for the product or article.

SUMMARY OF THE INVENTION

Embodiments of the invention include a foldable tag having multiple fold segments and an expandable loop conjoined to the multiple fold segments. The expandable loop is stretched or expanded to secure the tag around an article or a group of articles. In illustrated embodiments, the foldable tag includes multiple fold segments to form a bi-fold tag or alternatively a tri-fold tag. As disclosed, the expandable loop is formed along a portion of an elastomeric sheet that is conjoined with a tag portion along a relatively flat bonding segment. In illustrated embodiments a plurality of separable tags are connected along a rupturable connection. The plurality of separable tags can be disposed in one or more strips or wound in a roll.

This summary is not intended to describe each disclosed embodiment or every implementation of the present invention. Many other novel advantages, features, and relationships will become apparent as this description proceeds. The figures and the description that follow more particularly exemplify illustrative embodiments.

BRIEF DESCRIPTION OF THE DRAWINGS

The present invention will be further explained with reference to the attached figures, wherein like structure or system elements are referred to by like reference numerals throughout the several views.

While the above-identified figures set forth several embodiments of the present invention, other embodiments are also contemplated, as noted in the disclosure. In all cases, this disclosure presents the invention by way of representation and not limitation. It should be understood that numerous other modifications and embodiments can be devised by those skilled in the art which fall within the scope and spirit of the principles of this invention.

DETAILED DESCRIPTION OF ILLUSTRATIVE EMBODIMENTS

FIGS. 1-6 illustrate embodiments of foldable tags of the present invention. The illustrated embodiments shown have a variety of applications. For example, the illustrated embodiments can be used as product tags for labeling food products or other retail products as well as gift tags for packages. In an example embodiment, the foldable tags disclosed herein can be used to bind together agricultural products such as asparagus, or floral arrangements or can be affixed to bottles, such as ketchup and syrup bottles, or jars. Although the present application recites a variety of illustrative uses for embodiments of the foldable tags described herein, use is not limited to the specific applications described.

Figure 1:
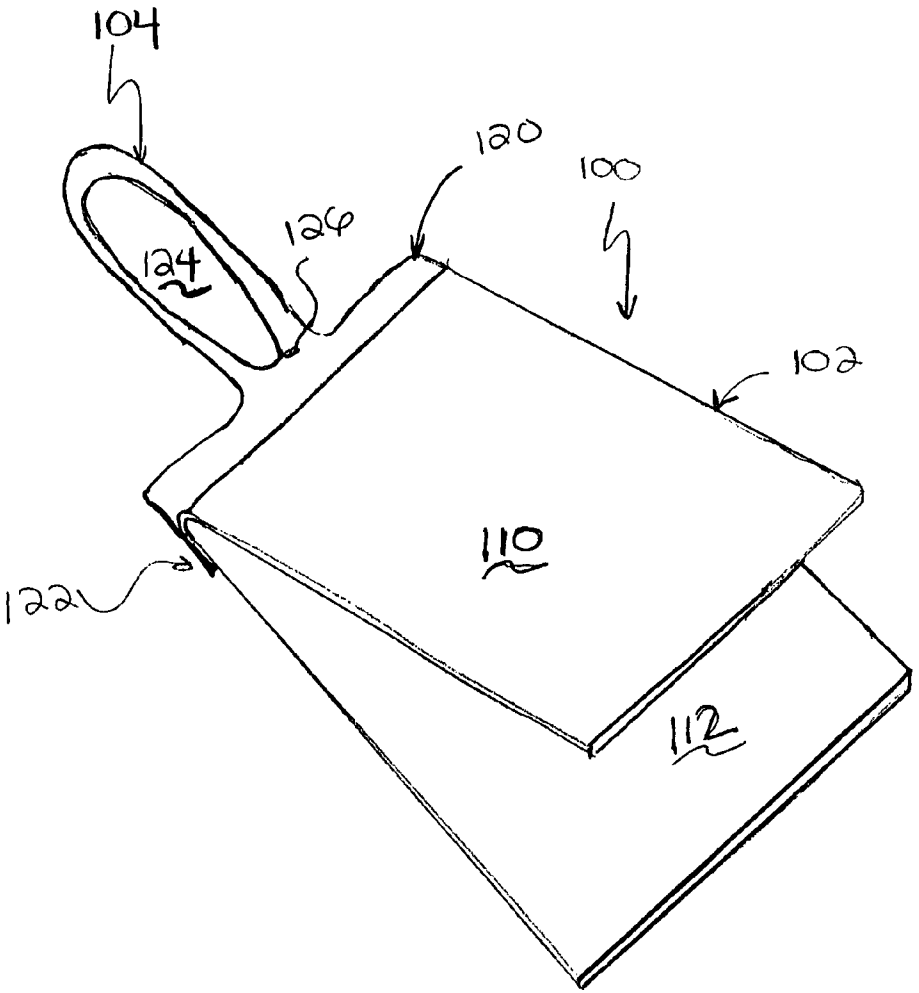
FIG. 1 is a perspective illustration of an embodiment of a bi-fold tag.
Figure 2:
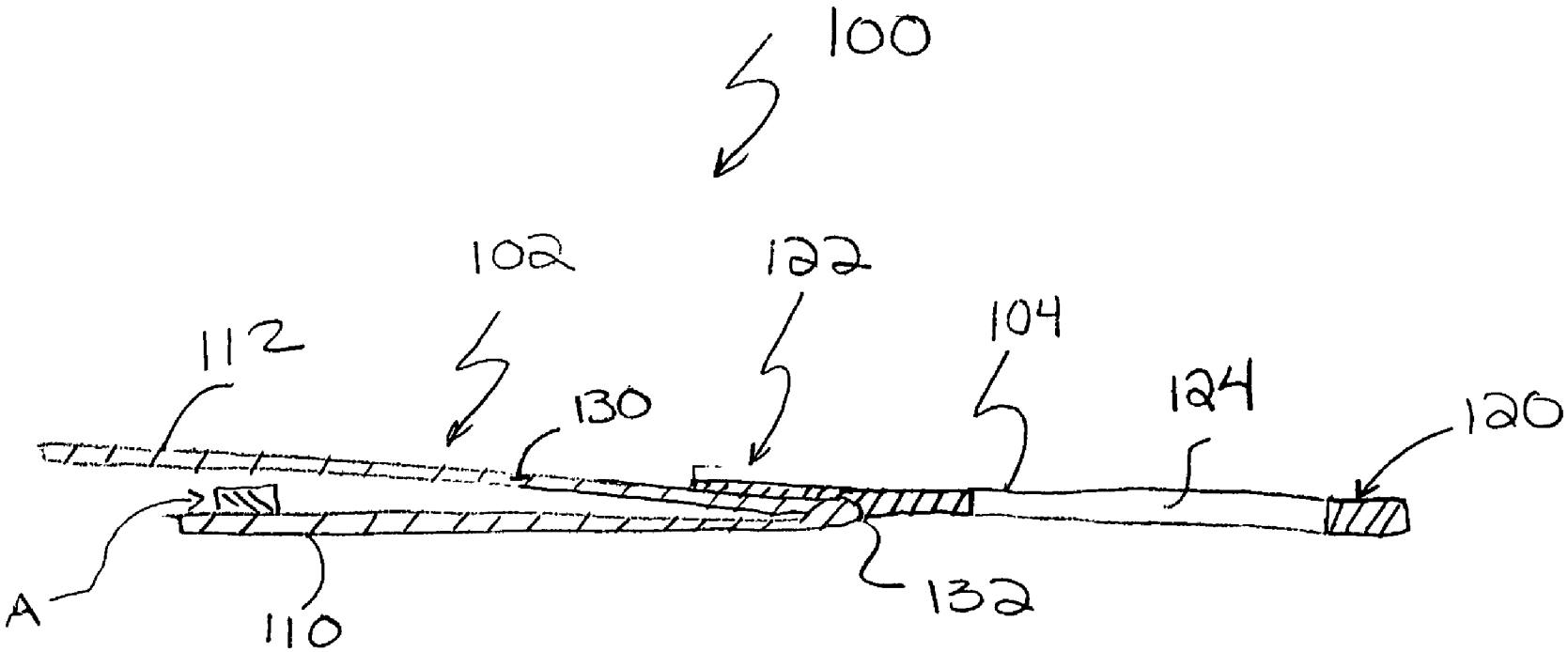
FIG. 2 is a cross-sectional view of the bi-fold tag illustrated in FIG. 1 in a folded position.

FIGS. 1-2 illustrate an embodiment of a foldable tag 100, which as shown, includes a printable tag portion 102 and an expandable loop 104. The printable tag portion 102 can be formed of variety of materials that can be printed with text or other indicia as disclosed herein and as will be appreciated by those skilled in the art. As shown, the printable tag portion 102 includes bi-fold segments 110, 112 to form a bi-foldable tag. The bi-fold segments 110, 112 are folded to provide a relatively flat profile and can be opened or unfolded for viewing.

The expandable loop 104 extends from the printable tag portion 102 and is formed of a relatively thin elastomeric sheet 120 that is conjoined with the tag portion 102 along a relatively flat bonding segment 122. As shown, the flat bonding segment 122 of the elastomeric sheet 120 overlaps with the printable tag portion 102 and is bonded to a surface of the printable tag portion 102. The overlapping region of the flat bonding segment 122 and printable tag portion 102 is sufficient so that the expandable loop 104 does not separate from the tag portion 102 during use. For example, the overlap is generally about 3/16 or 1/4 inch or even 3/8 inch but typically not over about 1/2 inch or more.

The elastomeric sheet 120 includes a relatively flexible portion that extends from the flat bonding segment 122 to form the expandable loop 104. The expandable loop 104 is formed about an open area or cut-out area 124 of the relative flexible portion of the elastomeric sheet 120. The loop is sized and shaped to provide sufficient expansion so the loop 104 can be secured about (i.e., stretched over) various articles or products depending upon the desired application or use. Although FIGS. 1-2 illustrate a particular loop shape or design, application is not limited to the particular shape or design shown. For example, the expandable loop 104 can be oval, round or elongate shape depending upon the desired application and such characteristics as the elasticity of the elastomeric sheet 120, the width of the loop band and the size of the open area 124.

As shown, the relatively flexible portion of the elastomeric sheet 120 includes a transition portion 126 disposed between the flat bonding segment 122 and the expandable loop 104. In the embodiment shown, the transition portion 126 includes a narrow neck portion that functions to disperse tension forces created as a result of the stretching or expansion of the expandable loop 104. Dissipation of the tension forces is desirable to reduce stress on the elastomer in the flat bonding segment 122. The dimension and contour of the transition or neck portion 128 is designed based upon the size, shape and elastic characteristics of the expandable loop 104.

As shown in FIG. 2, bi-fold segments 110, 112 are formed of folded sections of a relatively stiff printable sheet 130. The printable sheet 130 is relatively stiff in comparison to the elastomeric sheet 120 forming the expandable loop 104. As shown, the printable sheet 130 includes a folded edge 132 that separates or forms the bi-fold segments 110, 112. In illustrated embodiments, the length of bi-fold segment 112 is longer than bi-fold segment 110, however, application is not limited to a particular size, shape or relation of the bi-fold segments 110, 112. As shown in FIG. 2, the elastomeric sheet 120 is conjoined to the printable sheet 130 along the folded edge 132 that separates the bi-fold segments 110, 112.

The printable sheet 130 of the tag can be formed of different materials depending upon the application or use. In one embodiment, a polyolefin thermoplastic microporous product called "Teslin" from PPG Industries of Pittsburgh, Pa. can be used or alternatively, Polylith GC-2, 8 mil PP available from Granwell Products, Inc. of West Caldwell, N.J. Depending upon the application, it may be desired to use a water resistant material so that the tag does not wrinkle or disintegrate in water or a non stretchy material so that indicia or printing on the tag can be scanned without distortion or deterioration.

Other useful materials for the sheet material include paper, polystyrenic thermoplastics as well as polyolefinic thermoplastics, polyesters, or materials such as high-impact polystyrene sheets or other materials or blends of materials. Different material can be blended to achieve desired coloration opacification and adhesion and other properties as will be appreciated by those skilled in the art. To improve impact properties, a styrene-butadiene-styrene impact modifier can be useful. The sheet can be treated with a corona treatment as available from Pillar Technologies of Hartland, Wis., a division of Illinois Tool Works to enhance wettability and adhesion characteristics of plastic substrates to inks and adhesives.

The elastomeric sheet 120 can be a rubber-like material that has sufficient elasticity or bounce back from a stretched condition. Examples of thermoplastic elastomers for the elastomeric sheet 120 include styrenic block co-polymers including styrene-butadiene styrene and styrene-ethylene-butylene styrene or olefinic elastomers including those that are ethylene as well as those that are polypropylene based polyvinyl chloride-based elastomers, urethanes, nylon, silicon, etc. The elastomeric sheet 120 can be formed of a single layer or multiple layers including a possible protective layer.

The elastomeric sheet 120 will generally have a layer thickness that is greater than a thickness of the printable sheet by at least about 20 percent up to about four-six times the thickness of the tag portion. In an illustrative embodiment, the thickness of the tag portion is in the range of 10 mils (and not over about 15-20 mils in thickness) and the thickness of the expandable loop 104 is in the range of 15 to 30 mils in thickness. As shown in FIG. 2, a thickness of a portion of the elastomeric sheet forming the neck portion and expandable loop is thicker than the conjoined portion of the elastomeric sheet forming the relatively thin bonding segment 122.

The size, shape and dimensions of the expandable loop 104 should permit stretching of the loop to a size at least three times greater than a relaxed unstretched size. The relaxed unstretched opening may range from as little as about 1.5 inches up to illustratively 5 inches. In an illustrative embodiment, a width of a perimeter of the expandable loop 104 is in a range of 1/10 in (100 mils)-½ inches (50 mils) and a thickness of the expandable loop 104 is between 0.012 inches (12 mils) and 0.030 inches (30 mils).

In one illustrative embodiment, the printable sheet 130 of the tag portion 102 is formed of a polystyrene material and the elastomeric sheet portion 120 is formed using a styrene-butadiene-styrene (SBS) block co-polymer available from GLS Corporation under the tradename "Kraton D-2104" or alternatively, 50/50 blend of Kraton D2104/Kraton D210 with a 0.5% Kemamide slip additive (with or without color concentrate). To improve adhesion of the elastomeric sheet 120 to a styrenic tag portion, an optional addition of up to 10 percent by weight of polystyrene (based on the weight of the elastomer in the composition) may be blended in the elastomer composition. The composition can easily be colored, as for example by using polystyrene base color concentrates from Clariant (located at 9101 International Parkway, Minneapolis, Minn. 55428) or by using polyethylene base color concentrates from Ampacet (located at 660 White Plains Road, Tarrytown, N.Y. 10591) at concentrations of up to about 5 percent of the weight of the base styrene-butadiene-styrene block co-polymer.

Different bonding technique and structures can be used to conjoin the printable sheet 130 with the elastomeric sheet 120 in a manner forming the unifying flat bonding zone that can withstand the pulling force or expansion of the expandable loop 104. For example, the flat bonding zone between the tag portion 102 and elastomeric sheet 120 can be heat welded, or sonically welded. Alternatively, the overlapping bond between the printable sheet 130 and the elastomeric sheet 120 can be formed by laminating a molten elastomer to a molten (or at least softened) tag portion or by interposing a comparable intermediate layer (e.g., a hot melt bonding adhesive) between the printable sheet 130 of the tag portion and the elastomeric sheet 120.

As previously described, text or other indicia maybe printed on the printable sheet 130 of the tag portion using various inks or printing processes as will be appreciated by those skilled in the art. Depending upon the inks or printing processes used it may be necessary to apply an intermediate or primer layer to a substrate layer or sheet material to facilitate bonding of certain inks to the substrate layer or sheet material. For example, a primer layer may be coated on a surface of a Polylith GC-2, 8 mil PP substrate layer prior to printing text and other indicia on that surface of the tag portion of the foldable tag. An example of a primer layer of this type is Digiprime 4431, available from Michelman, Inc., Cincinnati, Ohio. As previously discussed, the elastomeric sheet or portion is bonded to the tag portion along a flat bonding segment 122. Depending upon characteristics of the primer layer, a compatible coating or layer (which, in some instances, may be the ink) may be disposed between the primer layer and elastomeric sheet to facilitate bonding of the elastomeric sheet to the tag portion.

Figure 2A:
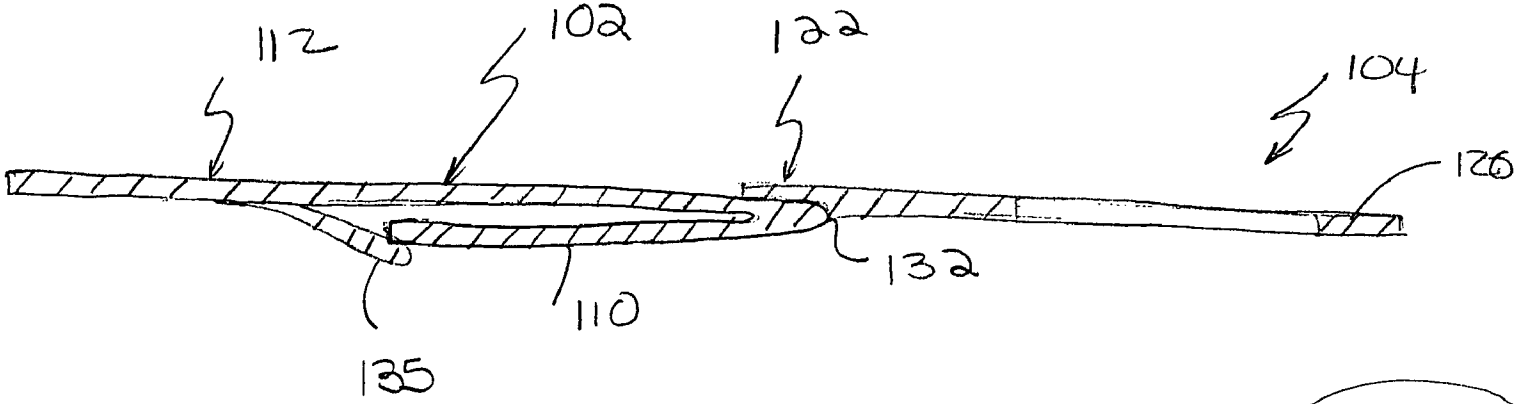
FIG. 2A is a cross-sectional view of a bi-fold tag including a closure flap.
Figure 2B:
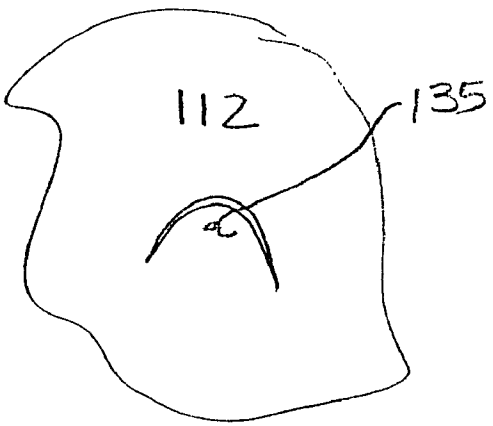
FIG. 2B is a front view illustrating the closure flap of the bi-fold tag of FIG. 2A.

As shown in FIGS. 2A-2B the fold segment 110 of the tag portion can be secured via a closure flap 135 cut or formed in fold segment 112 to retain the fold segments 110, 112 in a folded position.

Figure 3:
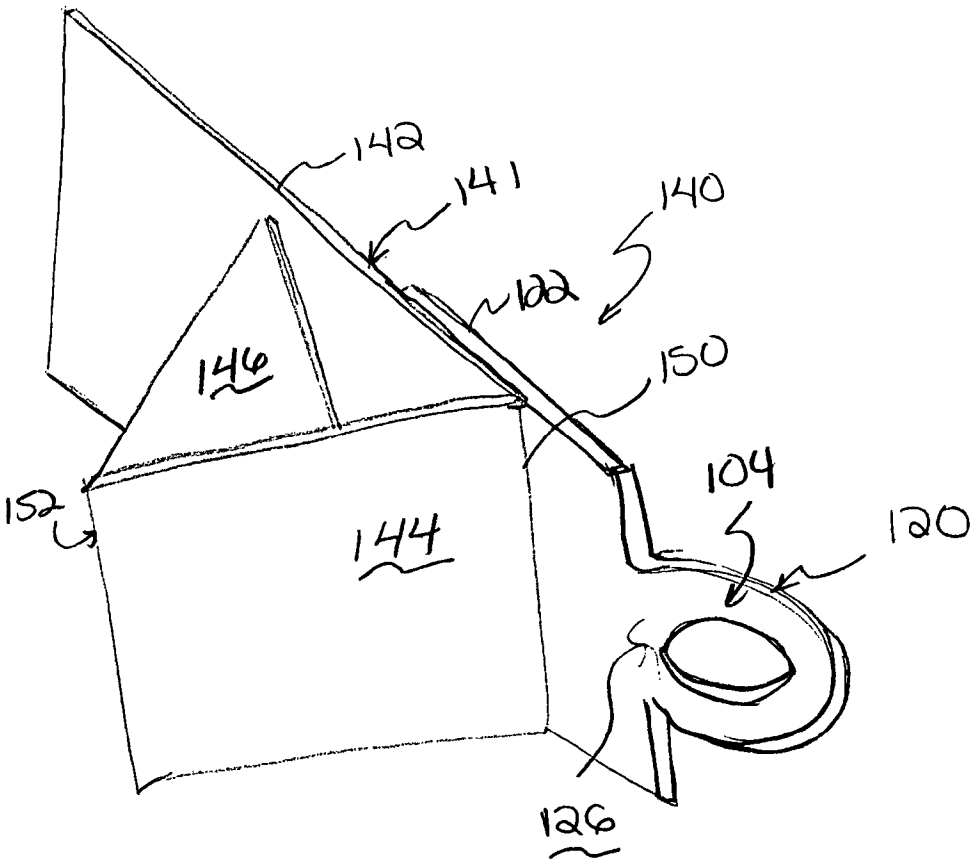
FIG. 3 is a perspective illustration of an embodiment of a tri-fold tag.
Figure 4:
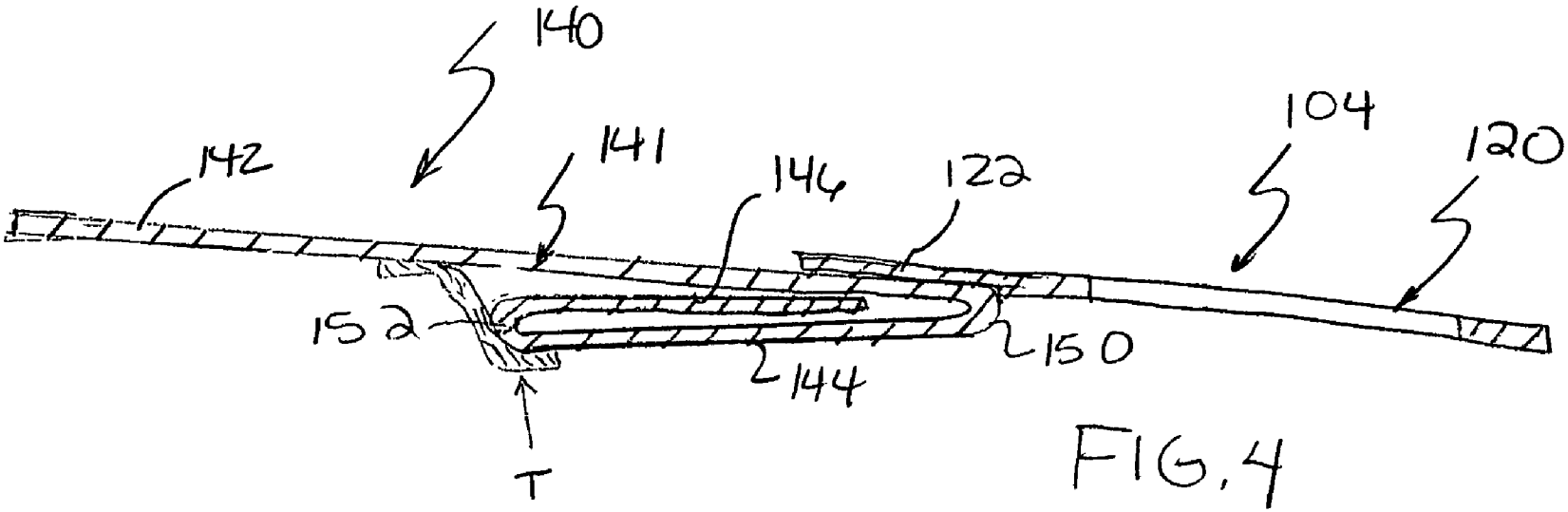
FIG. 4 is a cross-sectional view of the tri-fold tag illustrated in FIG. 3.

FIGS. 3-4 illustrate an embodiment of a tri-fold tag 140 having a tri-fold tag portion 141 having tri-fold segments 142, 144, 146 which lay relatively flat when folded and are opened or unfolded for viewing. As shown, the tri-fold segments 142, 144, 146 include end segments 142, 146 and an inner segment 144 disposed between end segments 142, 144. As shown, elastomeric sheet 120 is bonded to end segment 142 of tag portion 141 along a folded edge 150 separating end segment 142 and inner segment 144 to form the expandable loop 104.

In the illustrated embodiment, the tri-fold segments 142, 144, 146 fold in a nested pattern as comparatively illustrated in FIG. 3 and FIG. 4. In the nested pattern, the end segment 146 is folded along a folded edge 152 and is disposed between end segment 142 and inner segment 144. The direction of folds along the folded edges 150, 152 allows end segment 146 to fold between end segment 142 and inner segment 144 to provide the nested fold pattern illustrated in FIG. 4.

Figures 5, 6:
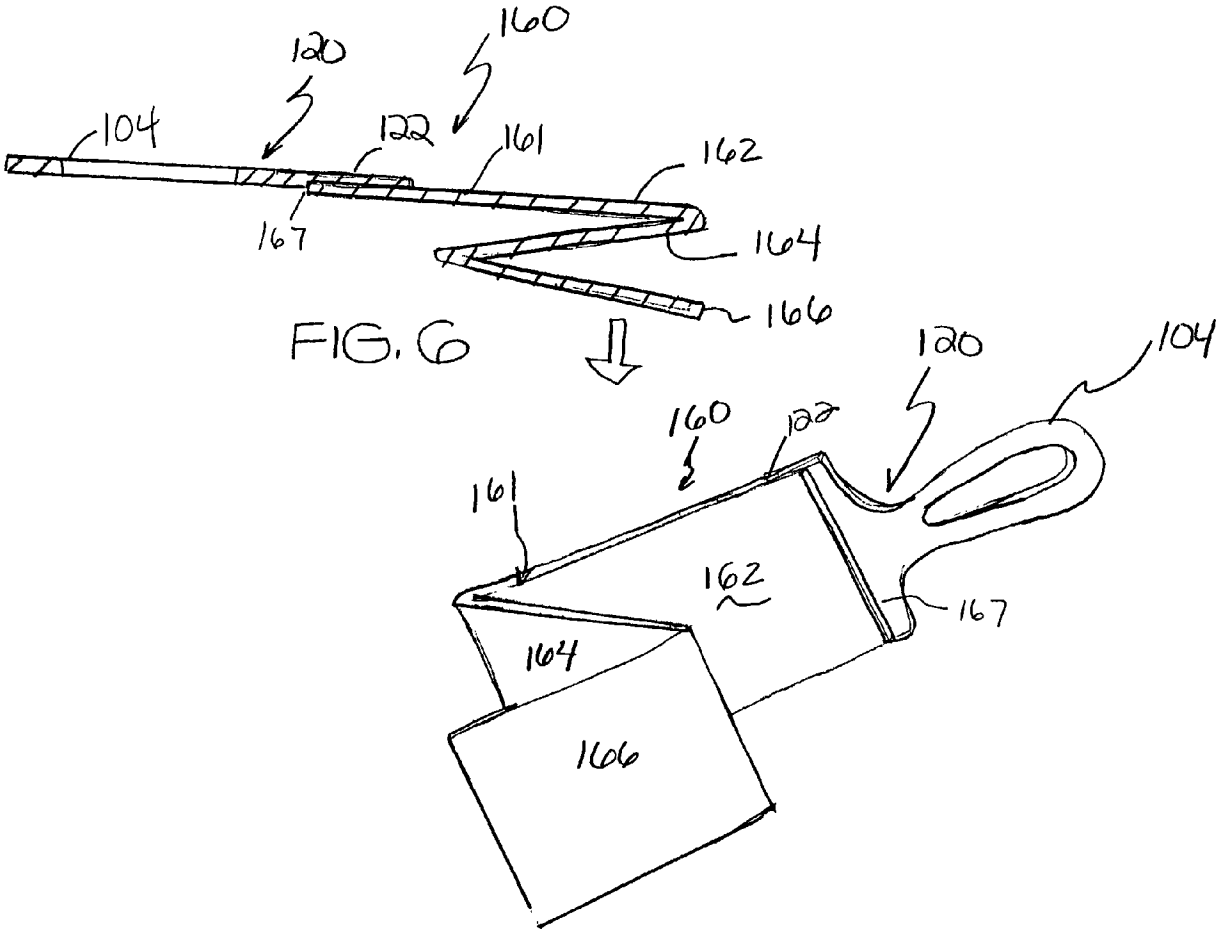
FIG. 5 is a perspective illustration of another embodiment of a tri-fold tag foldable in an accordion pattern.
FIG. 6 is a cross-sectional view of the tri-fold tag illustrated in FIG. 5.

FIGS. 5-6 illustrate another embodiment of a tri-fold tag 160 having tri-foldable tag portion 161 including segments 162, 164, 166. As shown, segment 164 is disposed between end segments 162, 166. In the embodiment shown, the elastomeric sheet 120 is bonded to segment 162 along an unfolded edge 167 of the tag portion 161 to form the expandable loop 104 conjoined to and extending from the tri-foldable tag portion 161. The segments 162, 164, 166 of the tri-fold tag 160 are formed so that the segments 162, 164, 166 fold in an accordion pattern to collapse the tri-fold tag 160.

Although FIGS. 1-6 illustrate one embodiment of a bi-fold tag and alternate embodiments of tri-fold tags, application is not limited to the particular embodiments shown. For example, the elastomeric sheet 120 can be attached to different fold segments or different folded and unfolded edges of the tag portion depending upon the design or fold orientation desired. For example, elastomeric sheet 120 can be conjoined along a non-folded edge of the bi-fold tag shown in FIG. 1 so that the foldable tag opens along a side edge in contrast to the folded edge 132 shown in FIG. 2.

Figure 7:
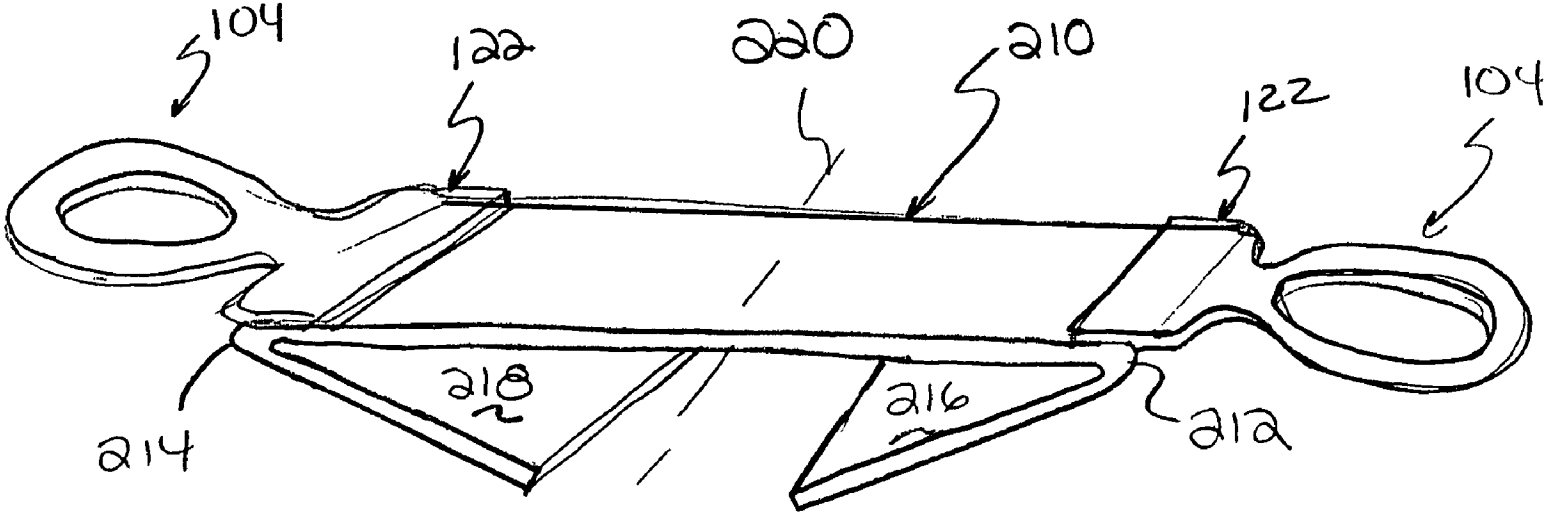
FIG. 7 illustrates a printable sheet folded to form multiple bi-fold tags as illustrated in FIGS. 1-2.

FIG. 7 illustrates a printable sheet 210 for fabricating a plurality of bi-fold tags of the type illustrated in FIGS. 1-2. As shown, the sheet 210 includes opposed folded edges 212, 214 to form folded sections 216, 218 along opposed sides of the sheet 210. Expandable loops 104 are formed along the opposed folded edges 212, 214 to form multiple bi-folded tags separable along separation line 220.

Figure 8:
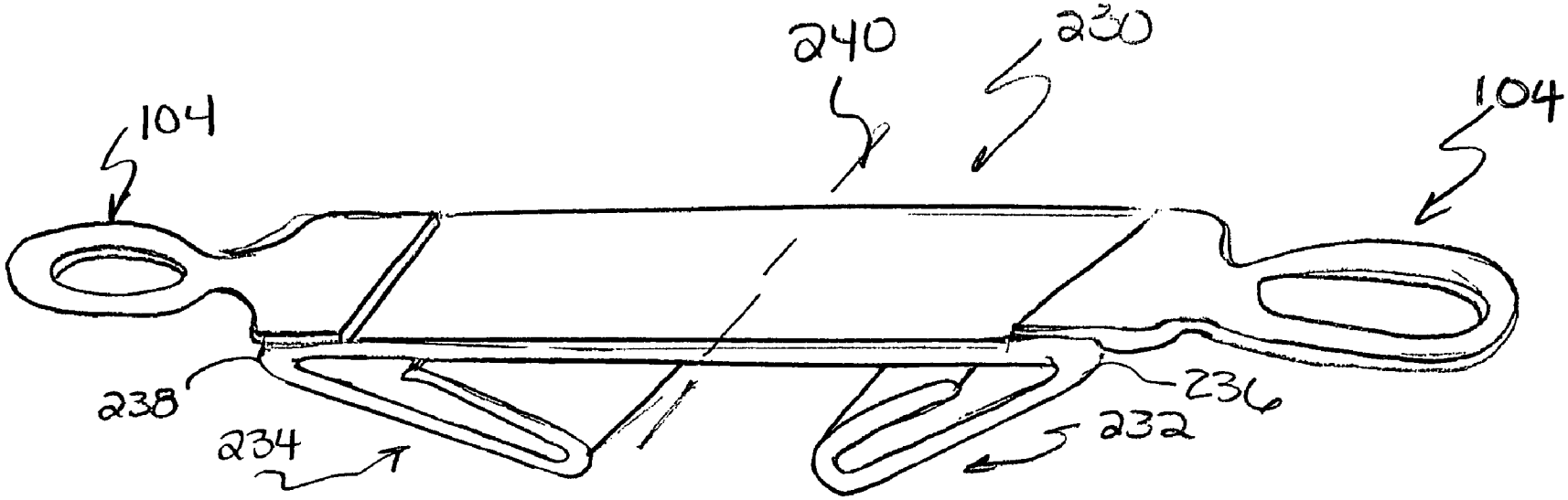
FIG. 8 illustrates a printable sheet folded to form multiple tri-fold tags foldable as illustrated in FIGS. 3-4.

FIG. 8 illustrates a printable sheet 230 for fabricating a plurality of tri-fold tags that are foldable in the nested pattern illustrated in FIGS. 3-4. As shown, the sheet 230 includes opposed multi-folded sections 232, 234 along opposed folded edges 236, 238 of sheet 230 that form tag segments 144, 146 of the tri-fold tag. Expandable loops 104 are fabricated along the opposed folded edges 236, 238 and the multiple tri-fold tags are separated along separation line 240.

Figure 9:
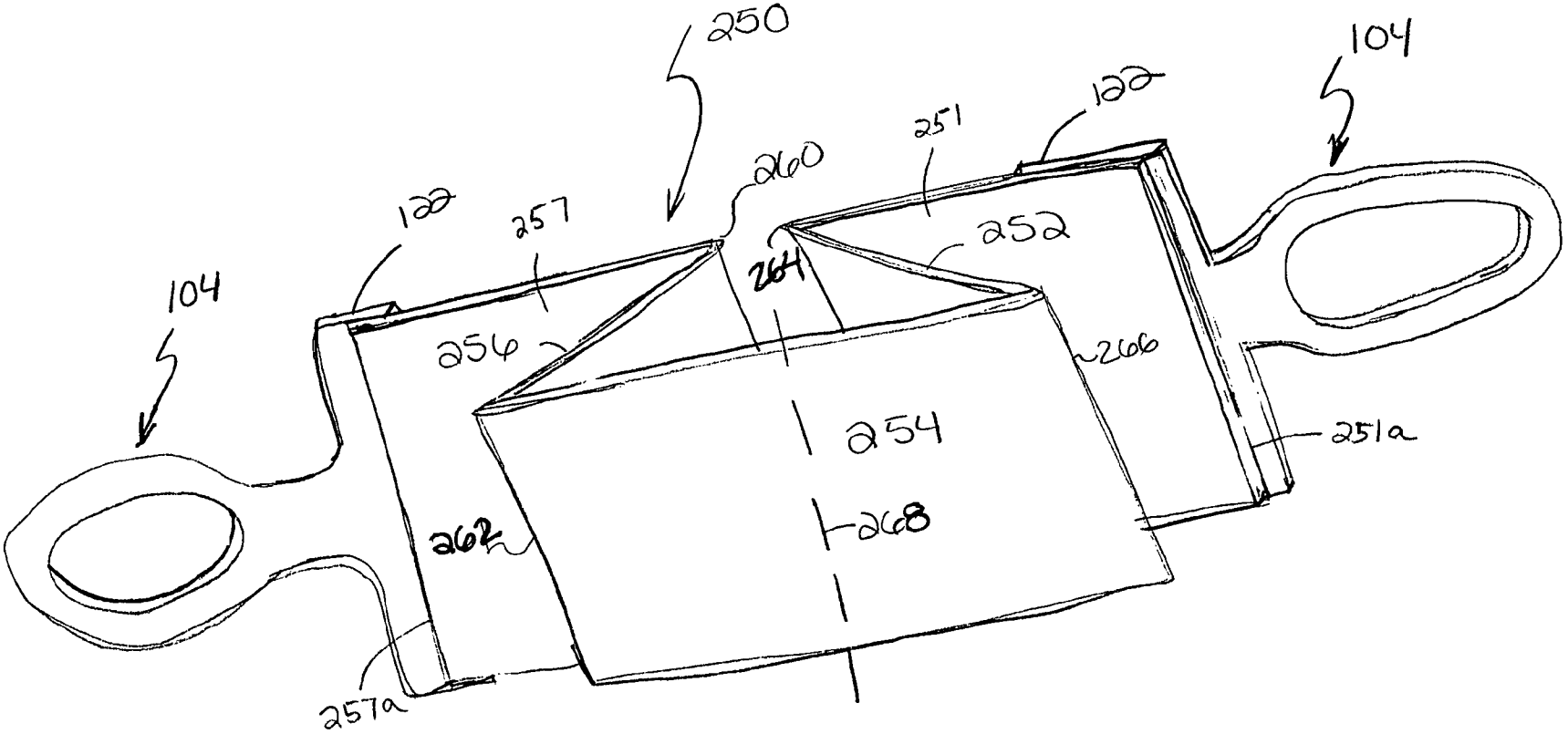
FIG. 9 illustrates a printable sheet folded to form multiple tri-fold tags foldable as illustrated in FIGS. 5-6.

FIG. 9 illustrates a printable sheet 250 for fabricating a plurality of tri-fold tags that are foldable in an accordion pattern as illustrated in FIGS. 5-6. As shown, the sheet 250 includes multi-folded sections 251, 252, 254, 256, 257. Section 252, 254, 256 form tag segments 164, 166 of the tri-fold tag (see FIGS. 5 and 6). Sections 252, 256 are formed between folded edges 260, 262 and folded edges 264, 266, respectively. Section 254 is formed between folded edges 262, 266. Expandable loops 104 are fabricated on the opposed sections 251 and 257 of sheet 250, along end edges 251*a*, 257*a* thereof, respectively. Sheet 250 is severed along separation line 268 line within section 254 formed between folded edges 262, 266 to form multiple tri-fold tags foldable in the accordion pattern as illustrated in FIGS. 5-6.

Figure 10:
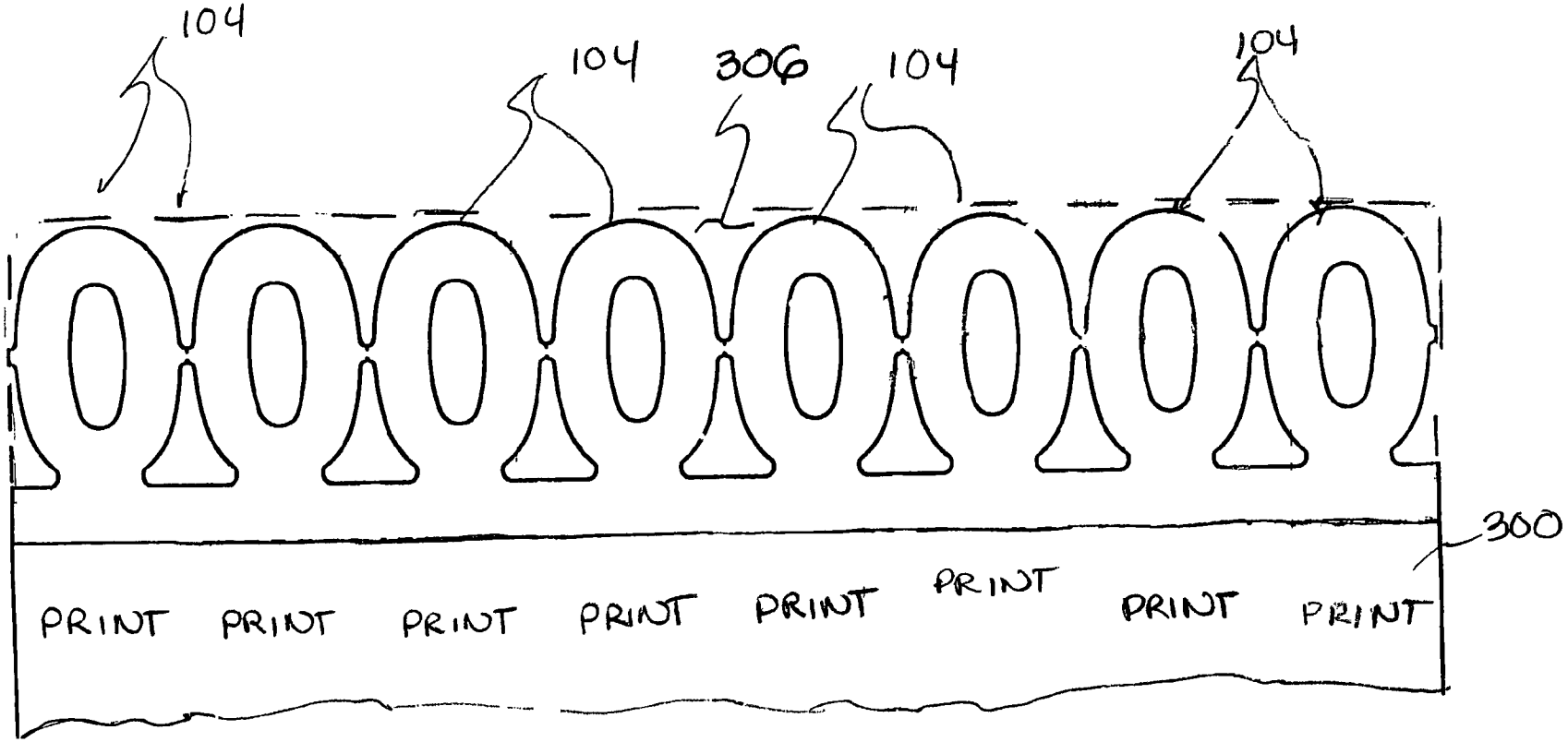
FIG. 10 illustrates a web sheet for forming a plurality of foldable tags.

In illustrative embodiments, a plurality of foldable tags can be formed using batch or web-based processing techniques. For web-based processing, a plurality of tags are formed on a folded or foldable web sheet 300 as illustrated in FIG. 10. As shown, the foldable or folded web sheet 300 includes a plurality of expandable loops 104 fabricated along a length of the foldable or folded web sheet 300 to form the plurality of foldable tags as illustrated by process steps 302, 304 of FIG. 11.

Figure 11:
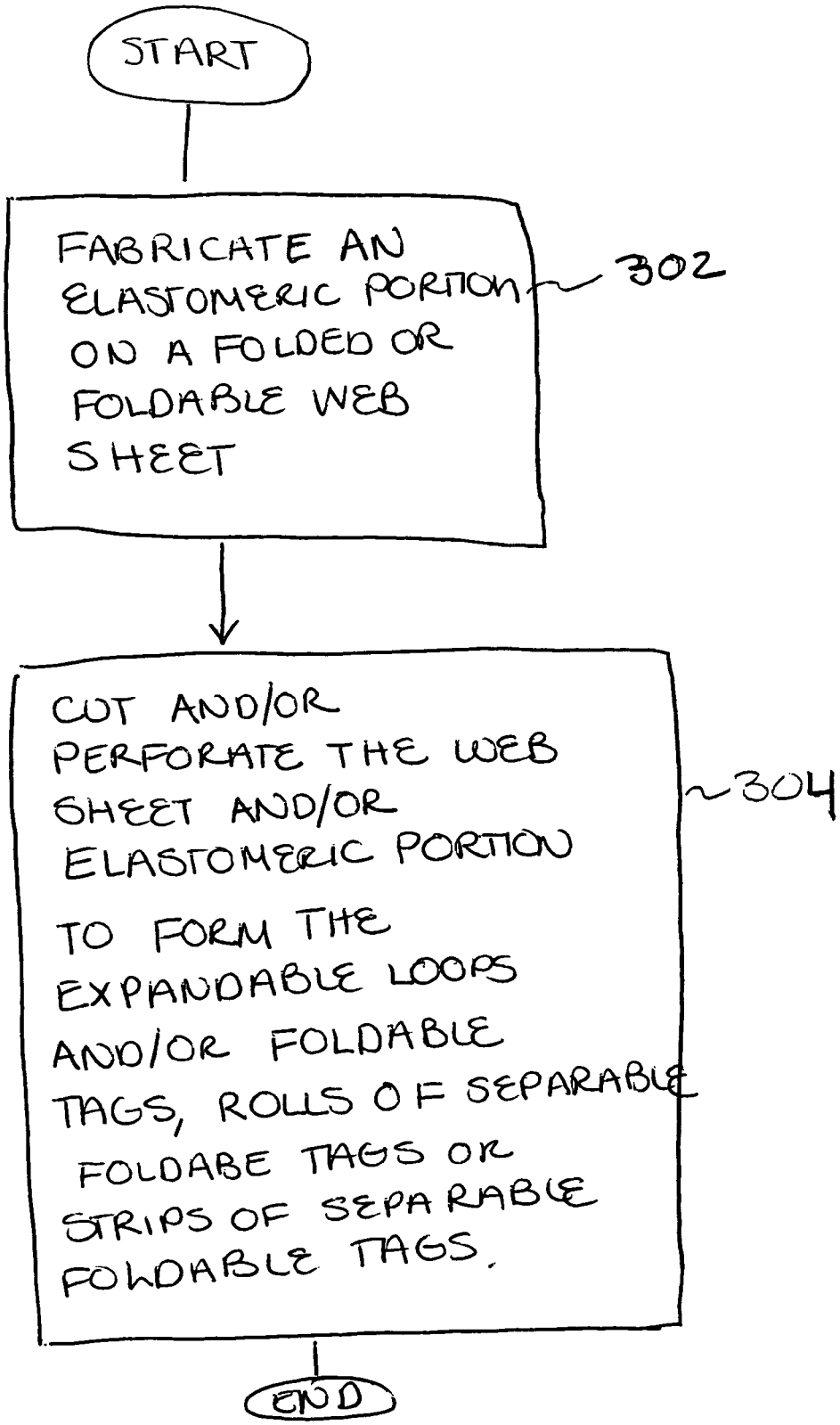
FIG. 11 is a flow chart illustrating steps for fabricating foldable tags of the illustrated embodiments.

In step 302 of FIG. 11, an elastomeric portion or layer 306, illustrated in phantom in FIG. 10., is fabricated along the length of the foldable or folded web sheet 300 which when cut forms a pattern or plurality of expandable loops 104 as shown in FIG. 10. In FIG. 10, the elastomeric portion or layer 306 is fabricated or deposited along single edge or side of the web sheet 300. In alternative embodiments, the elastomeric portion or layer 306 is fabricated along opposed edges or sides as illustrated in the embodiments of FIGS. 7-9. In step 304 of FIG. 11, web sheet 300 and the elastomeric portion 306 are cut and/or perforated to form the pattern of expandable loops 104 and to form individual tags, or rolls or strips of separable tags. Steps 302 and 304 can be implemented in a single process step or multi process steps. In the web process, the web sheet 300 can be repetitively printed with informational matter or text to form a plurality of printed tags. Although FIG. 10 illustrates a printed web sheet, application is not limited to printed tags and the tags may be colored or having other markings as will be appreciated by those skilled in the art.

In an illustrative embodiment, the elastomer portion 306 is fabricated on the web sheet 300 in step 302 by applying a molten elastomer (e.g., a thermoplastic elastomer such as styrenic block copolymer) to an edge or surface of the web sheet 300 as the web sheet 300 is fed to form the overlapping bonding segment 122 and the flexible elastomeric sheet portion extending from the overlapping bonding segment 122. In an illustrative embodiment, the overlapping bonding segment 122 is formed as the web sheet 300 is passed through a nip of chill rollers. The temperatures of the chill rollers (from about 200 degrees Fahrenheit to about 40 degrees F.) is adjusted to cool the molten elastomer to a "frozen" state while simultaneously applying pressure by the rollers (up to about 500 psi) to effect the formation of the elastomer sheet at the thickness desired and also to effect formation of the bonding segment or zone 122. Thereafter the elastomeric sheet is die cut and/or perforated to form the plurality of expandable loops 104 for the plurality of folded or foldable tags and/or to separate individual tags or form a plurality of separable tags or strips from the web.

As previously described in FIG. 11, the web sheet 300 can be cut and/or perforated to form individual tags, strips of separable tags or rolls of separable tags. In the illustrative embodiment of FIG. 12 the plurality of tags form a dual strip of separable tags including a first strip of tags 370 and a second strip of tags 372. The first and second strips of tags 370, 372 are connected along a perforated or rupturable connection 374 to separate the strips of tags. Additionally as shown, the tags of the first and second strips 370, 372 are connectable along perforated or rupturable connections 376 to separate individual tags from the strips of tags. The web sheet 300 can be folded using the fold patterns illustrated in FIGS. 7-9 for fabricating multiple strips of tags or alternately can be folded using other patterns for forming a single strip of tags having the elastomeric sheet or portion conjoined along a single edge or side of the printable sheet or tag portion.

Figure 12:
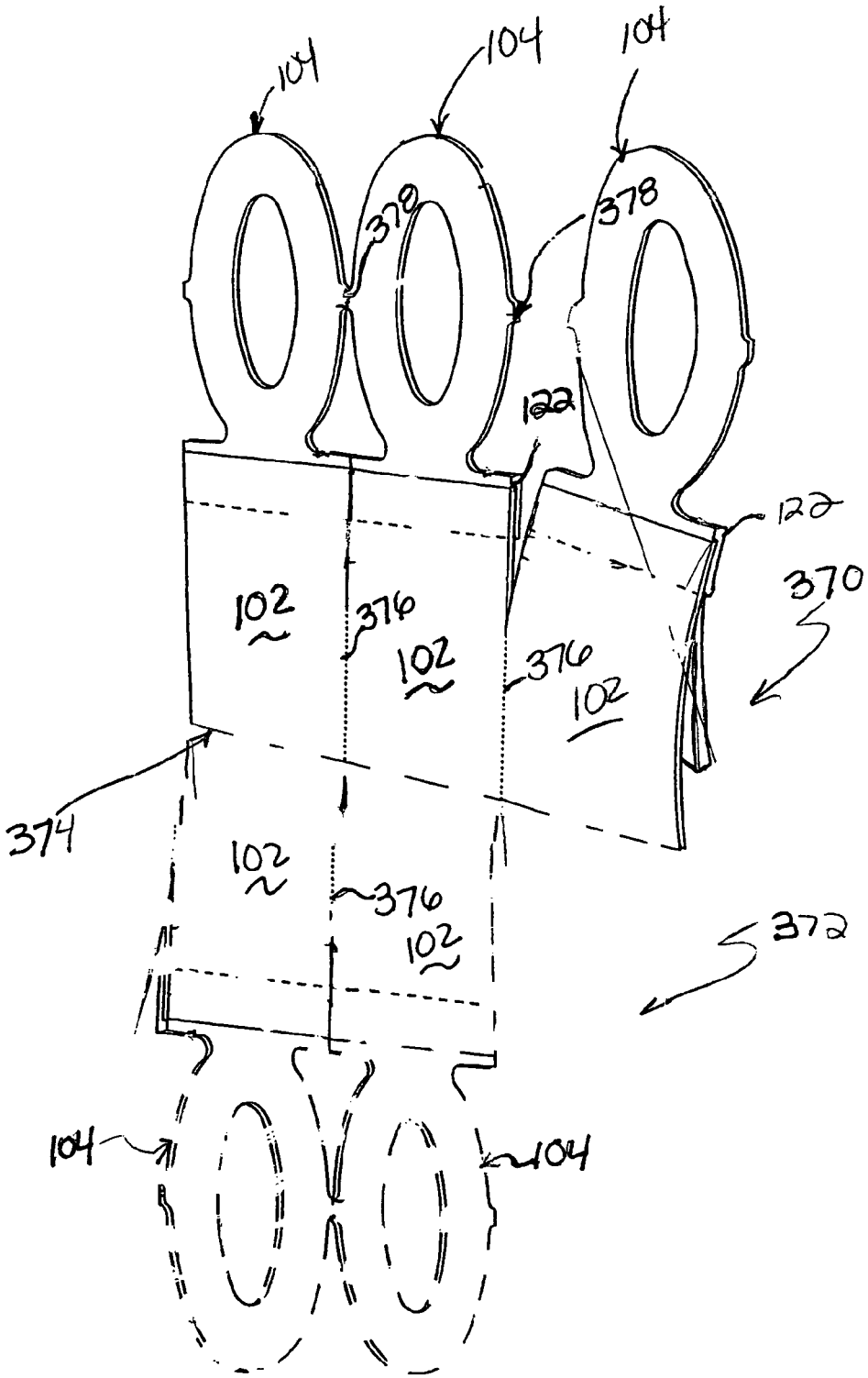
FIG. 12 illustrates multiple strips of separable tags.

In the embodiment illustrated in FIG. 12, the expandable loop portions 104 are connected by rupturable connections 378. In an alternate embodiment, the expandable loops 104 are separated during the cutting process. The rupturable connections or segments are designed for ease of separation of the tags while sufficiently holding the tags together for handling purposes. In the illustrated embodiment, tags are not connected along the bonding segment 122 for ease of separation. In an illustrative embodiment, the elastomeric sheet and printable sheet are cut using a die (e.g., a die in registration with printed indicia on the web sheet) to form the expandable loops and cut the individual tags or perforations or connecting links for a plurality of separable tags.

Figure 13:
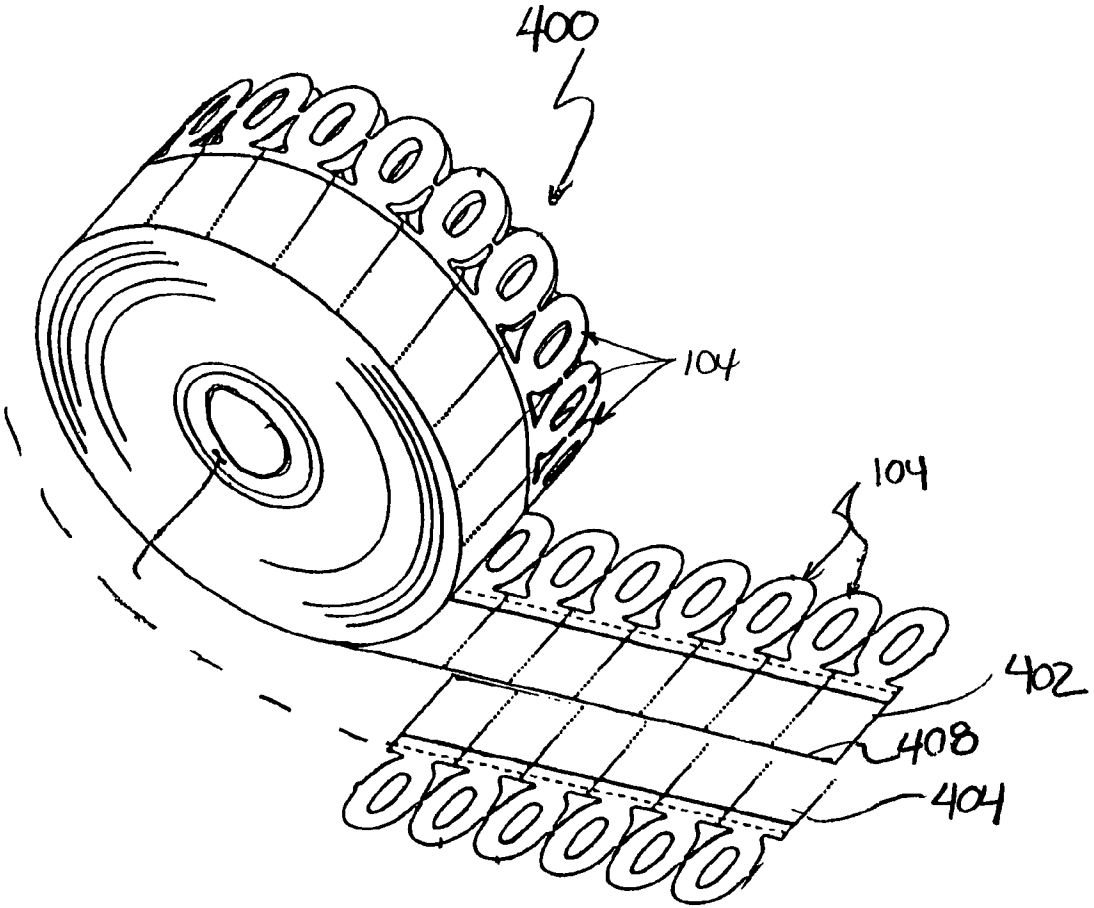
FIG. 13 illustrates a roll of separable tags.

Additionally, the plurality of separable tags can be arranged in a roll 400 as illustrated in FIG. 13. In the embodiment shown, the roll 400 is formed by winding two strips of tags 402, 404 about a common or separate cardboard cores of the same diameter. The cardboard cores are located on a first common shaft which, as is generally known, has a slip clutch to facilitate coordinated shaft rotation with the speed of the web sheet and to follow the speed of die cutting. Once the roll of tags is wound, the two wound strips 402, 404 can be separated along a perforation or rupturable connection 408 to form two separate rolls. As previously described, individual tags can be readily and easily removed, one by one, from the free end of the roll or rolls via rupturable connections or by other means as will be appreciated by those skilled in the art.

In one embodiment, a foldable tag of the present invention may include an aid in keeping the tag portion folded. For instance, an adhesive A (see FIG. 2) (e.g., silicone or a pressure sensitive adhesive) may be disposed between folded segments of the tag portion. When exposure of the inside panels of the folded segments is desired, a user overcomes the force of the adhesive A and peels the segments apart (see, e.g., FIG. 1). Alternatively, a layer of tape T (see FIG. 4) (e.g., pressure sensitive adhesive tape) may be applied across two segments of the tag portion to bind them together. When exposure of the inside panels of the folded segments is desired, a user removes the tape from adhesion to at least one of the tag segments and unfolds the segments apart (see, e.g., FIG. 3).

Further, those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

What is claimed is:

1. A plurality of separable tags comprising:

a printable sheet having at least one foldable edge separating a plurality of foldable portions wherein the plurality of foldable portions fold and unfold along the at least one foldable edge;

a plurality of expandable loops formed on a portion of an elastomeric sheet conjoined with the printable sheet along an overlapping bonding segment; and a plurality of rupturable connections to form the plurality of separable tags each having a plurality of foldable segments and at least one expandable loop wherein the plurality of separable tags includes a first strip of tags connected along at least one first rupturable connection and a second strip of tags connected along at least one second rupturable connection and the first and second strips of tags being connected along a third rupturable connection.

2. The plurality of separable tags of claim 1 wherein the elastomeric sheet is conjoined to the tag portion along the at least one foldable edge of the printable sheet.

3. The plurality of separable tags of claim 1 wherein the printable sheet includes opposed spaced foldable edges and elastomeric sheets are flatly conjoined along the opposed spaced foldable edges and the printable sheet is separable along the third rupturable connection to form the first and second strips of tags formed along the opposed spaced foldable edges.

* * * * *